US006666770B1

(12) United States Patent
Kubo et al.

(10) Patent No.: US 6,666,770 B1
(45) Date of Patent: Dec. 23, 2003

(54) GAME SYSTEM, RECORDING MEDIUM, AND IMAGE DISPLAY METHOD

(75) Inventors: Morikuni Kubo, Tokyo (JP); Tsutomu Watanabe, Tokyo (JP)

(73) Assignee: Konami Corporation, Tokyo (JP)

( * ) Notice: Subject to any disclaimer, the term of this patent is extended or adjusted under 35 U.S.C. 154(b) by 700 days.

(21) Appl. No.: 09/624,969

(22) Filed: Jul. 24, 2000

(30) Foreign Application Priority Data

Jul. 23, 1999 (JP) ..... 11-209582

(51) Int. Cl.[7] ..... A63F 13/00
(52) U.S. Cl. ..... 463/43; 463/11; 273/308
(58) Field of Search ..... 463/1, 11, 4, 7, 463/42, 43; 273/308

(56) References Cited

U.S. PATENT DOCUMENTS 5,569,082 A 10/1996 Kaye
5,570,887 A * 11/1996 Christie, Jr. ..... 273/261
5,662,332 A * 9/1997 Garfield ..... 273/308
6,132,315 A * 10/2000 Miyamoto et al. ..... 463/43
6,267,678 B1 * 7/2001 Kubo et al. ..... 463/44
6,322,077 B1 * 11/2001 Braunlich et al. ..... 273/292
6,375,566 B1 * 4/2002 Yamada ..... 463/1
6,398,651 B1 * 6/2002 Yamada ..... 463/43
6,544,119 B2 * 4/2003 Kubo et al. ..... 463/11
6,595,851 B1 * 7/2003 Kubo et al. ..... 463/1

FOREIGN PATENT DOCUMENTS

GB 2 230 462 10/1990
JP 2000-157744 6/2000

* cited by examiner

*Primary Examiner*—John M Hotaling
(74) *Attorney, Agent, or Firm*—Sughrue Mion, PLLC

(57) ABSTRACT

A card game involving a high degree of strategy can be performed because card merge and reinforcement processing brought about by placing a plurality of cards is executed during a hand card process sequence prior to placement of each card on an arena area. Furthermore, it is possible with a game system and a recording medium to avoid to overuse face-down placement of specific cards that bring about specific effects, such as merges, reinforcement. Such overusing can be accomplished by imposing taxes on each player against merges and reinforcement involving a plural number of cards in the hand card sequence, and also against the face down placement of the specific cards.

17 Claims, 9 Drawing Sheets

ATTRIBUTE AND FACE UP OR FACE DOWN SELECTION PHASE

GAME SYSTEM, RECORDING MEDIUM, AND IMAGE DISPLAY METHOD

BACKGROUND OF THE INVENTION

1. Field of the Invention

The present invention relates to a game apparatus, game system, and recording medium, and particularly to a card game apparatus, card game system, and card game recording medium for playing a card game. The present invention also relates to an image display method capable of displaying images peculiar to this card game.

2. Description of the Related Art

Conventionally, proposals have been made about various kinds of card games wherein cards are prepared as card hands for each player. Usually, such cards include a plurality of cards having mutually different attributes and ability indexes and are given the life points (hereinafter abbreviated to LP) to players. Each card game is played until the life points of either one of the players becomes "0" by locating these cards at determined places (for example, the specification in U.S. Pat. No. 5662332).

The applicant, meanwhile, in Japanese Unexamined Patent Publication (JP-A) No. 2000-157744, earlier has proposed a card game for a portable game machine which can be enjoyed in the form of a video game. In that card game, each player selects cards having differing ability indexes and functions, from many types of the cards and plays those at prescribed places set on the screen of the portable game machine. The cards placed at the prescribed places by the players are compared with each other by the use of such as a computer in the portable game machine. Thereafter, the winner is determined by the relative superiority of the cards. In this card game also, cards are mutually played out until the life points of one player becomes "0." This card game can be played by a single player while viewing the display screen of a liquid crystal display (LCD) in the portable game machine. In addition, it can also be played between a plurality of players by communicating with other portable game machines by infrared light, etc.

Description will be made this more specifically about the card game previously proposed. In the card game, a first player can arrange five cards in a first player hand card area predetermined for his or her own hand while a second or opponent player can also five cards in a second or an opponent hand card area. Such first and second player hand card areas are determined in the upper and lower portions of a liquid crystal display screen. In addition, an area on the screen excluding the first player hand card area and the opponent hand card area is determined as a playing field which might be called a playing arena for playing the game. In this case, cards are arranged face down in the first player hand card area and the opponent hand card area. Cards laid face down on the playing arena during a battle, are turned face up, and the relative superiority of the cards is determined. In this condition, the player can view the cards placed on the playing arena by the opponent, and can confirm the relative superiority of cards placed by himself or herself.

The cards in the card game described in the foregoing are categorized into a plurality of monster cards, magic cards, and field or terrain cards. Among others, the monster cards have predetermined offensive and defensive ability indexes while the magic cards affect the monster cards on the playing arena when they are placed from the hand card area into the playing arena. In addition, field cards determine the field of battle, and, in each battle field, modify the offensive and defensive ability indexes of the monster cards. In this card game, moreover, it is permissible to locate a plural number of cards from the hand card area onto the playing arena in one turn.

As described in the foregoing, by permitting a plural number of cards placed onto the arena during one turn, numerous variations can be provided in the card game. For example, when the combination of a plurality of monster cards placed during one turn is identical with a certain combination, the plurality of the cards can be merged into a single card which has different offensive and/or defensive ability indexes from the placed cards. In addition, when a combination of a monster card and a magic card fulfills certain conditions, reinforcement can be executed to get a monster card which has a higher ability index. In this way the card game can be made more interesting.

Now, the card game proposed in Japanese Unexamined Patent Publication (JP-A) No. 2000-157744 prepares seven hundreds (700) species of cards each of which is composed of ninety-nine (99) pieces. This enables to use a total number of 69,300 cards. Of these cards, 300 are stored in the storage unit, which may be called "Briefcase" in this card game. For a game, a card pile, that is, a "deck" is formed of 40 cards extracted from the "Briefcase." The 40 cards in the "deck" are shuffled, and five cards each are dealt to the player himself or herself and deployed in the first player hand card area.

In the case of the card game described in the foregoing, moreover, there are magic cards which, when played on the arena, exhibit special effects such as inflicting damage on an opponent or restoring one's own life points. Among these magic cards are special cards called trap cards which automatically become effective when the attack of an opponent satisfies certain conditions. These magic cards are normally deployed face down in a prescribed location. A specific magic card exhibits its effects when it is turned face up, or when a monster card deployed on the arena satisfies certain conditions.

The card game proposed in Japanese Unexamined Patent Publication (JP-A) No. 2000-157744, however, as noted earlier, considers only applications to portable game machines.

Meanwhile, various game machines are being proposed and widely used as game machines which can execute games according to a program stored in a recording medium. Accordingly, it is desirable in the interest of increased demand and so forth that the card games be made such that they can be enjoyed not only exclusively on portable game machines, but also on various type of home video game machine or commercial video game machine.

With the card games mentioned in conjunction with the portable game machines, a plural number of cards can only be placed only when the cards are deployed in the hand card areas of the players. Thereafter, they are moved onto the arena. With this structure, it is possible to manifest such special effects as merge or reinforcement, etc. Thus, the special effects can only be manifested when the cards are placed onto the arena in the above-mentioned card games. This results in spoiling a fun in the card game in view of strategy.

On the other hand, it is assumed that permission is made without restriction about both using magic cards and effecting reinforcement or merge and the like by placing a plural number of cards. In this event, interest in each player might be directed to gathering up specific magic cards and also only to expecting the special effects. As a consequence, there will be a danger that the strategic quality of the card game will be impaired, and that the number of turns will be diminished so that the interest of each player in the card game is reduced.

SUMMARY OF THE INVENTION

An object of the present invention is to provide a card game system which is not limited to a portable game machine but also is applicable to both a general home game machine and an arcade game machine, such as a business use game machine, and which is able to further enhance player interest in the card games.

Another object of the present invention is to provide a card game system wherewith a plurality of players can engage in card games while using a common display unit.

Yet another object of the present invention is to provide a card game system which can enhance the strategic element in card games while also making it possible to prevent merge, reinforcement, and specific magic cards from being overused.

An object of the present invention is to provide an image display method for conducting card games involving a high degree of strategy.

Another object of the present invention is to provide a recording medium which is capable of being read by a computer, and which stores a program necessary for the card game system and image display method described in the foregoing.

According to a first aspect of the present invention, there is provided a game system for use in executing a card game in accordance with a card game procedure which is divided into a hand card process sequence for arranging cards in a hand card area displayed on a screen and an arena card process sequence for arranging cards in an arena card area displayed on the screen; the game system comprising; input means for inputting control signals on the basis of manipulation of each player; and image display control means for performing processing to display images relating to the card game, in accordance with to the control signals and the card game procedure; wherein the image display control means comprises detection means, operable in the hand card process sequence, for detecting that an arrangement of a plurality of cards placed on the hand card area is matched with a prescribed combination, processing means for processing the arrangement the cards on the hand card area to display, on the screen, effects which correspond to the arrangement of the cards on detecting the match between the arrangement and the prescribed combination, and means for decreasing life points of each player as taxes on detecting the match between the arrangement and the prescribed combination.

According to a second aspect of the present invention, there is provided a card game system for use in executing a card game in accordance with a prescribed card game procedure, with images displayed on a display device; the card game system comprising: input means for inputting control signals in response to manipulation of each player; and image display control means, responsive to the control signals, for carrying out processing to display card game images on the display device in accordance with the card game procedure; the image display control means comprising: detection means, responsive to the control signals, for detecting whether or not the predetermined card combinations are indicated in the card game to produce occurrence of the predetermined card combinations; tax imposition means for imposing taxes on the player; and a processing unit for carrying out processing to display, on the card game images, effects associated with the occurrence of the predetermined card combinations; the tax imposition means comprising a computation unit for subtracting the taxes from life points of the player when the predetermined combinations are caused to occur; the image display control means displaying the effects produced due to the predetermined card combination before each card is placed on an arena.

According to a third aspect of the present invention, there is provided a game system for conducting a card game in accordance with a card game procedure which is divided into a hand card sequence for arranging cards in a hand card area displayed on a screen and a arena card sequence for arranging cards in a arena card area displayed on the screen; wherein cards used in the card game include a plurality of monster cards each of which has its own ability index; and magic cards that bring about prescribed effects on those monster cards; the card game system comprising: input means for inputting control signals; and image display control means, responsive to the control signals, for carrying out processing to display images relating to the card game in accordance with the card game procedure: the image display control means comprising: means for determining whether the magic cards are located in the hand card sequence, face up or face down; and means for reducing, as a tax, life points of a player who turns the magic cards face down.

According to a fourth aspect of the present invention, there is provided a computer-readable recording medium for storing a program for conducting a card game in accordance with a card game procedure which is divided into a hand card process sequence for arranging cards in a hand card area displayed on a screen and an arena card process sequence for arranging cards in a arena card area displayed on the screen; the program comprising the steps of: detecting, in the hand card process sequence, that an arrangement of the plurality of cards located on the hand card area is identical with a prescribed combination; carrying out processing to display effects corresponding to that prescribed combination on the screen, when the arrangement is identical with the prescribed combination; and reducing life points of players as taxes on detection of the prescribed combination.

According a fifth aspect of the present invention, there is provided an image display method for displaying images on a display device to conduct a card game in accordance with a card game procedure that is divided into a hand card process sequence for deploying cards in a hand card area and an arena card process sequence for locating cards on an arena card area; the method comprising the steps of: detecting that, in the hand card process sequence, an arrangement of the plurality of cards placed on the hand card area is matched with a prescribed combination; carrying out processing to display, on the screen, effects corresponding to that prescribed combination on detecting the match between the arrangement and the prescribed combination,; and reducing life points of players as taxes on detecting the prescribed combination; the effects on the screen being activated prior to the arena card process sequence.

DESCRIPTION OF THE PREFERRED EMBODIMENTS

In order to facilitate comprehension of the present invention, description will be made about a game apparatus to which the present invention is applicable.

Figure 1:
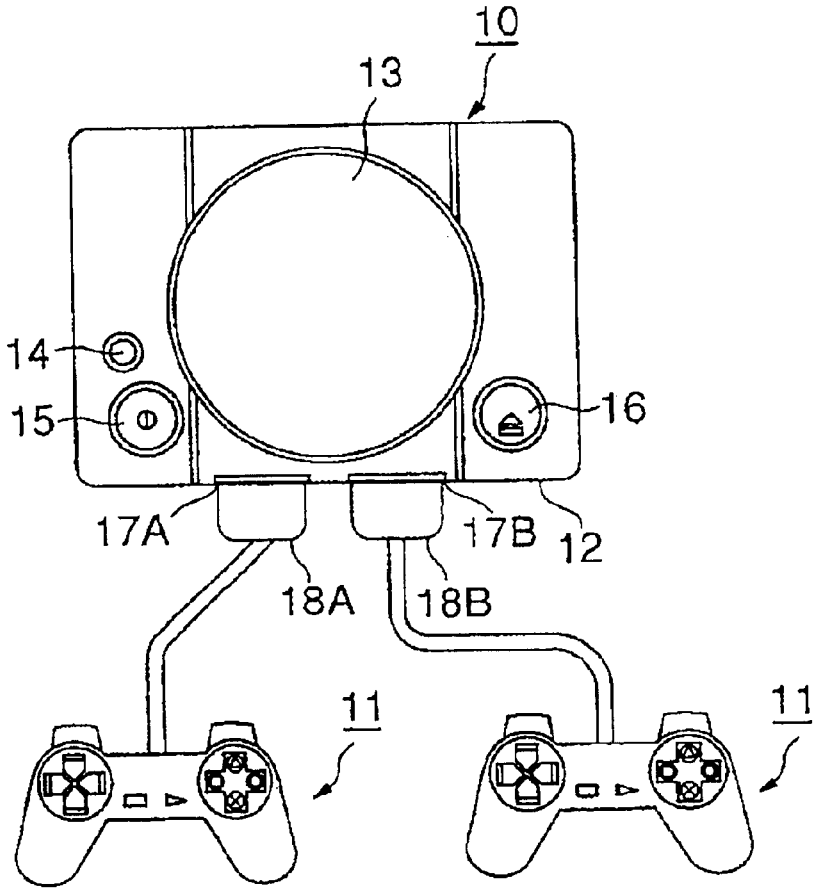
FIG. 1 is a plan for describing the general configuration of a game system to which the present invention is applicable.

Referring to FIG. 1, a home game machine to which the present invention is applicable comprises a main game machine unit (hereinafter called simply the main unit) 10, and two controllers 11 installed in the main unit 10. In order to play an ordinary or usual game, the main unit 10 is connected to a television receiver (not shown). Under the circumstances, players can enjoy the video game by manipulating the controllers 11 while viewing the television screen.

Specifically, the main unit 10 comprises a housing 12 of a substantially rectangular shape, and a disk loading or mounting unit 13 in the center on the top surface of the housing 12. The disk mounting unit 13 can be opened and closed. In the illustrated home game machine, an optical disk (not shown) is loaded into the disk loading unit 13 and may be operable as a recording medium configured by a CD-ROM which stores a video game application program.

On the upper surface of the housing 12 configuring the main unit 10 are also provided a reset switch 14 for resetting the video game by the operation of a player, a power switch 15, and a disk operating switch 16. The disk loading unit 13 is opened and closed by operating the disk operating switch 16 so that an optical disk can be attached or ejected.

On the front side of the housing 12 are provided two slots, 17A and 17B for accommodating memory cards or the like. In the illustrated example, the controllers 11 are connected to the main unit 10 through connection terminal units 18A and 18B, respectively, within the two slots 17A and 17B.

Figure 2:
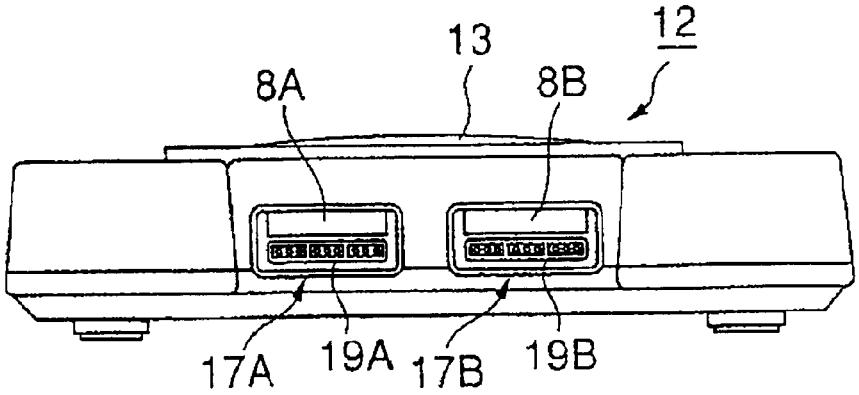
FIG. 2 is a front elevation for more specifically describing a game machine main unit for configuring the game system shown in FIG. 1.

Referring also to FIG. 2, each of the slots 17A and 17B provided in the front side of the main unit 10 have a two-stage structure with upper and lower shelves. In the lower shelves of the slots 17A and 17B are provided controller connection units 19A and 19B for connecting the two controllers 11, while in the upper shelves are provided memory card insertion units 8A and 8B for loading memory card devices (not shown).

Figure 3A:
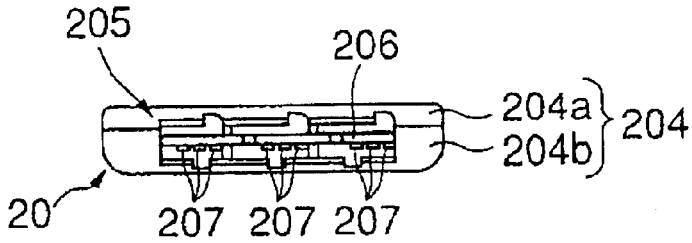
FIGS. 3A, 3B, and 3C are an upper side elevation, plan, and lower side elevation of a memory card device used in the game system shown in FIG. 1.
Figure 3B:
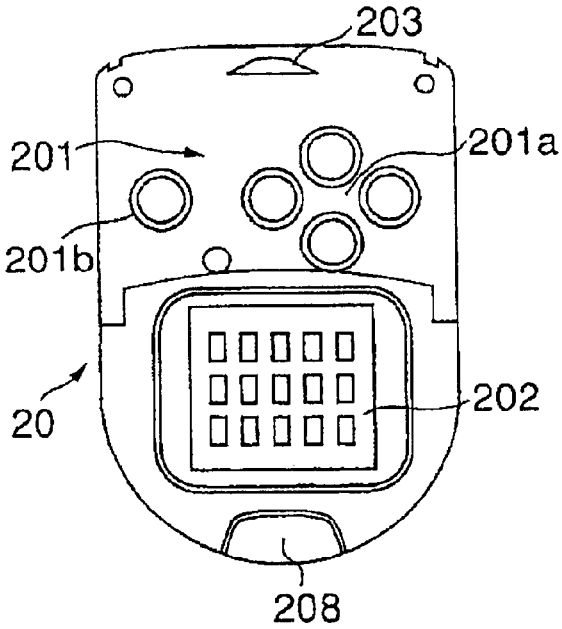
Figure 3C:
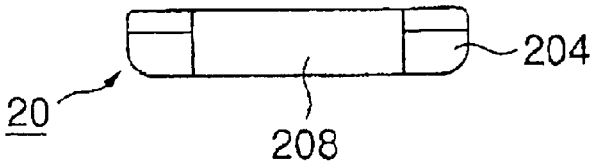

Referring to FIGS. 3A to 3C, a memory card device 20 can be attached to each of the memory card insertion units 8A and 8B in the slots 17A and 17B shown in FIG. 2. The memory card device 20 can download and store data and programs from the main unit 10, and can also be used by itself as a portable game apparatus, as will be described subsequently.

The memory card device 20 shown in FIGS. 3A to 3C has the upper surface shown in FIG. 3B, an upper end for inserting itself into the main unit, as shown in FIG. 3A, and a lower end opposite to the upper end, as shown in FIG. 3C. As shown in FIG. 3B, button switches 201 are provided on the upper surface of the memory card device 20, together with a liquid crystal display (LCD) 202 that forms display images and an arrow 203 indicating the direction in which it is to be inserted into the slot unit 17. In the example shown, the button switches 201 comprise up, down, left, and right buttons 201*a* and a button 201*b* for entering and determining events and numbers, etc.

Furthermore, the memory card device 20, as is evident from the upper end for inserting into the main unit shown in FIG. 3A, has a package 204 formed by an upper shell 204*a* and a lower shell 204*b*, with a connector window 205 formed in the upper end of the package 204. Inside the package 204 is accommodated a board 206 on which are mounted a memory device, microcomputer, etc., and power and signal connection terminals 207 are also provided. As shown in FIG. 3C, furthermore, on the lower end opposite to the upper end, wireless communication means are provided in the form of a wireless communication window 208 for sending out infrared beams for performing communications with other memory card devices using infrared light.

In the memory card device 20 shown in FIGS. 3A to 3C, a card game apparatus according to the present invention is used to verify the species, ability indexes, and attributes of one's own cards by moving a cursor over cards of players displayed face down on the display device.

To this end, the memory card device 20 is provided with a microcomputer that configures a control unit, program memory for storing programs from the main unit 10, non-volatile memory configured by a SRAM or the like, and batteries. Thus, because the memory card device 20 itself is equipped with batteries, programs and data downloaded into the memory card device can be preserved.

With the card game relating to the present invention, the card numbers, card names, and ability indexes, etc., of the cards in the deck used in the card game are downloaded into the memory card device 20 from the main unit 10 before the card game is played, and displayed on the liquid crystal display unit 202 of the card game apparatus 20. On the display device connected to the main unit 10, meanwhile, are displayed the numbers of cards in the deck that are placed face down. The card pile which forms the deck differs from each other for each player. Furthermore, the card numbers in the deck assigned to the cards displayed face down on the main unit 10 is different from each other for each player.

Under the circumstances, only one player can verify the content of his or her own cards that are laid face down by searching the card numbers with the card game apparatus 20.

Figure 4:
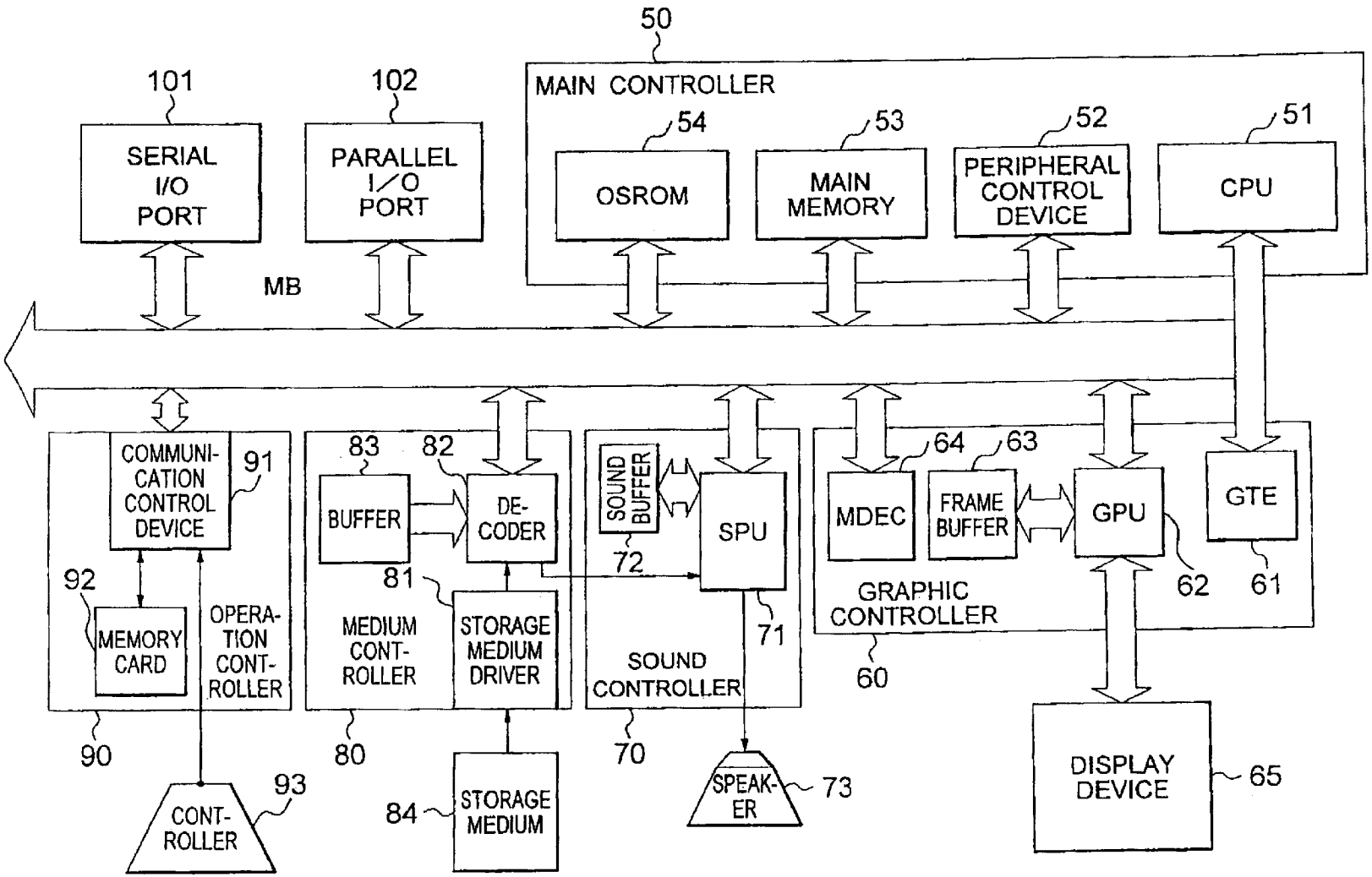
FIG. 4 is a simplified diagram for more specifically describing a controller used in the game system shown in FIG. 1.

Next, with reference to FIG. 4, description is made about the internal configuration of the main game unit 10 in which the memory card device 20 relating to the present invention is loaded.

First, a recording medium 84 on which a program relating to the game, such as an optical disk (CD-ROM or other disk-shaped recording medium), for example, is loaded into the main game unit 10 to play a game. The optical disk in this embodiment aspect is assumed to have stored thereon a program relating to the card game.

More particularly, the game apparatus according to the present invention comprises a main control unit 50, a graphic control unit 60, an audio control unit 70, a medium control unit 80, and a communication control unit 90, as shown in FIG. 4. These control units 50 to 90 may be collectively called the control block. The control units 50 to 90, that is, those constituting the control block, are all connected to a main bus MB. In the example shown, moreover, a serial I/O port 101 for connecting other peripheral equipment and a parallel I/O port 102 for communicating with other game apparatuses and the like are connected to the main bus MB. The main control unit 50, control input control unit 90, and medium control unit 80 operate as game control units for controlling the execution of the game in response to player control inputs in the controllers 11 that operate as control input units.

The main control unit 50 shown is configured by a central processing unit (CPU) 51, a peripheral device controller 52, a main memory 53, and an operating system (OS) ROM 54. More specifically, the peripheral device controller 52 in the main control unit 50 performs interrupt control, timing control, memory control, and control over direct memory access (DMA) transfers, etc. On the other hand, the main memory 53 is configured by an RAM of a memory capacity of 2 megabytes, for example, while the OS ROM 54 is configured by a 512-kilobyte memory, for example. The OSROM 54 stores programs for the so-called operating system or the like which manages the main memory 53, the graphic control unit 60 (operable as a graphic system), and the audio control unit 70 (operable as a sound system), etc., as mentioned before.

The illustrated CPU 51 is formed by a 32-bit RISC (reduced instruction set computer) CPU and is operable to control overall devices by executing the operating system (OS) stored in the ROM 54. The illustrated CPU 51 also has a command cache and a scratch pad memory and also manages a real memory.

The graphic control unit 60 is configured by a geometry transfer engine (GTE) 61, a graphic processing unit (GPU) 62, a frame buffer 63, and an expansion circuit 64. The display device 65 is connected to the GPU 62 in the graphic control unit 60. In this case, the graphic control unit 60 operates as a display control unit to control the display on the game screen in the display device 65.

The display device 65 noted here may be a television receiver in the case of an ordinary home game machine, a computer display in the case of a personal computer or work station, and a game display device in the case of a commercial game machine.

The geometry transfer engine (GTE) 61 in the graphic system 60 described before is configured by a coordinate computing coprocessor that performs coordinate conversions and other processing. The graphic processing unit (GPU) 62, on the other hand, performs image drawing in accordance with drawing instructions (drawing commands) from the CPU 51. The images drawn by this GPU 62 are stored in the one-megabyte frame buffer 63, for example. The expansion circuit 64 performs direct conversions, such as so-called discrete cosine transforms, and also is configured by an image decoder (hereinafter called an MDEC) 64 that decodes image data subjected to being compressed and encoded.

The geometry transfer engine (GTE) 61 described before comprises, for example, a parallel processing mechanism that executes a plurality of computations in parallel. The GTE 61 is operable as the coprocessor of the CPU 51 and carries out, in response to processing requests from that CPU 51, conversion, such as coordinate conversion, light source computations based on computations of the inner products of normal vectors and light source vectors. For example, fixed decimal point type matrix and vector computations can be carried out at high speed by the illustrated GTE 61.

More specifically, in cases where computations are done to implement flat shading that draws one triangular polygon in the same color, coordinate computations of around 1,500,000 polygons can be performed per second at maximum by the illustrated GTE 61. With this structure, the illustrated image processing system not only can reduce the loads on the CPU 51, but also can execute high-speed coordinate computations. It is to be noted that the polygon means a minimum graphical unit for displaying three-dimensional objects and may be a triangle or quadrangle. In the present invention, as will be described subsequently, coordinate computations are performed for each polygon using the GTE 61.

The graphic processing unit (GPU) 62 operates according to polygon drawing commands from the CPU 51, and performs the drawing of polygons for the frame buffer 63. This GPU 62 is designed to draw up to 360,000 polygons in 1 second. This GPU 62, furthermore, has its own two-dimensional address space that is independent of the CPU 51, configured so that the frame buffer 63 maps thereto.

The frame buffer 63 is formed by a so-called dual port RAM, and is capable of simultaneously performing both drawing operation indicated from the GPU 62 or transfer operation indicated from the main memory 53, and read-out operation for the displays. More specifically, the frame buffer 63 has 1 megabyte of memory capacity, for example, and is handled, respectively, as 16-bit matrixes with 1024 pixels arranged in the horizontal direction and 512 pixels arranged in the vertical direction.

This frame buffer 63 can output any display area of the stored image display areas on the display device 65. In addition to the display areas for video signals, the frame buffer 63 also comprises a CLUT area for storing a color look-up table (CLUT) that is referenced when the GPU 62 is drawing polygons and the like, and a texture area for storing materials (textures) that are inserted (mapped) into the polygons that are coordinate-converted at drawing time and drawn by the GPU 62.

The frame buffer 63 shown is also capable of performing high-speed DMA transfers with the main memory 53.

The expansion circuit (MDEC) 64 in the graphic control unit 60, meanwhile, reads data from the recording medium 84 under the control of the CPU 51, decodes still picture or moving picture image data stored in the main memory 53, and again stores those data in the main memory 53. More specifically, the MDEC 64 is designed so that it can execute reverse discrete cosine transform (reverse DCT) computations at high speed. As a result, the MDEC 64 can expand compressed data read out from the recording medium 84, according to the procedures of the color still picture compression standard (so-called JPEG) or accumulated media type moving picture encoding standard (so-called MPEG).

These reproduced image data are stored in the frame buffer 63 after being passed through the GPU 62, and thereby can be used as background for the images drawn by the GPU 62 described earlier.

The audio control unit, that is, the sound system 70, comprises a sound playback processor (SPU) 71 for generating musical sounds and sound effects, etc., based on instructions from the CPU 51, a 512-byte sound buffer 72, for example, wherein are stored voice or musical data, etc., or sound source data, etc., read out from the CD-ROM, and a speaker 73 that serves as sound output means for outputting the musical sounds and sound effects, etc., generated by the SPU 71.

The SPU 71 described above is provided with ADPCM decoding functions for reproducing audio data that have been adaptive differential encoded (ADPCM [Adaptive Differential Pulse Code Modulation]), with 16-bit audio data as 4-bit differential signals, with playback functions for playing back sound effects and the like by playing back sound source data stored in the sound buffer 72, and with modulation functions for modulating and playing back the audio data, etc., stored in the sound buffer 72.

As mentioned before, it is readily understood that the SPU 71 at issue has a built-in ADPCM sound source 24 which has functions for looping automatic modification of motion parameters having time as a coefficient, and operates according to control inputs sent from the CPU 51. The SPU 71 also manages its own address space wherein the sound buffer 72 is mapped, transfers ADPCM data from the CPU 51 to the sound buffer 72, and plays back data by directly passing key-on, key-off, and modulation information.

The sound system 70 can be used as a so-called sampling sound source that plays back musical sounds and sound effects based on audio data, etc., stored in the sound buffer 72 according to instructions from the CPU 51.

Next, the medium control unit 80 is configured by a recording medium driver 81, a decoder 82, and a buffer-83, and the recording medium 84 is loaded into the recording medium driver 81. For the recording medium 84 here, a CD-ROM, hard disk, optical disk, flexible disk, or semiconductor memory or the like can be used. In this example, the description assumes the use of an optical disk, that is, a CD-ROM. Given this relationship, it is assumed that the recording medium drive 81 is a CD-ROM driver and that the decoder 82 is a CD-ROM decoder. The card game program relating to the present invention is stored in this recording medium 84.

The recording medium driver 81 described above has functions for playing back programs and data, etc., recorded on the recording medium 84 that is a CD-ROM disk, while the decoder 82 is provided with functions for decoding programs and data, etc., that are stored after an error correction code (ECC) has been added, for example. The buffer 83, furthermore, is configured by a RAM having 32 kilobytes of recording capacity, for example, for temporarily storing playback data from the recording medium driver 81.

Provision is made here so that, in terms of disk format, CD-DA or CD-ROM XA data, etc., can be supported, and the decoder 82 also operates as a part of the audio control unit 70 for playing back audio data recorded on the recording medium 84.

The audio data recorded on the disk played back by the recording medium driver 81 shown may be, in addition to ADPCM data (CD-ROM XA ADPCM data, etc.), so-called PCM data resulting from the analog/digital conversion of audio signals.

Of the audio data noted in the foregoing, ADPCM data are recorded with the differential of 16-bit data represented with 4 bits, and those ADPCM data are supplied to the SPU 71 described earlier after being subjected to error correction and decoding by the decoder 82. The data undergoes digital/analog conversion and other processing in the SPU 71 and are then sent to the speaker 73.

Meanwhile, the audio data formed by PCM data recorded as 16-bit digital data, for example, is decoded by the decoder 82 and then used for driving the speaker 73. The audio output from that decoder 82 first goes to the SPU 71 where it is mixed with the output of that SPU, then passed through a reverb unit to form the final audio output.

The control input control unit 90 provided in the game apparatus shown in FIG. 1 comprises a communication control device 91 that controls communication with the CPU 51 via the main bus MB, and an auxiliary memory (memory card) 20. To the communication control device 91 are connected the controllers 11 for inputting instructions from users, that is, from players. The auxiliary memory 20 is used here for storing game setting data and instruction input data, etc., from the controllers 11.

Next, the controllers 11, which are operable as an interface for transmitting the intentions of the users to the application, have multiple instruction keys, for example, for inputting instructions from the users. The states of these instruction keys are sent 60 times a second or so to the communication control device 91 by synchronous communications in accordance with instructions from the communications control device 91. The communication control device 91 thereupon transmits the states of the instruction keys of the controllers 11 to the CPU 51. In the example shown, the configuration is such that the controllers 11 can be connected to the two connectors, respectively, provided in the main unit 10. If multi-tap connectors are used, however, play is possible with a greater number of controllers connected to the main unit 10.

Thus, by manipulating the controllers 11, instructions from each player are input to the CPU 51, and the CPU 51 in the main unit 10 performs processing, according to the instructions from the players, based on the game program being run.

When it is necessary to store settings for the game being run or scores at the end of a game or midway in a game in memory, the CPU 51 sends those data to be stored to the communication control device 91. Thus, the communication control device 91 stores those data from the CPU 51 in the memory card device 20. As is evident from the drawings, the memory card device 20 is separated from the main bus MB, and therefore can be loaded and unloaded while the power is turned on. Thus, it is possible to store game settings and the like in a plurality of memory card devices 20.

Now, when read out operation is carried out about programs, displaying images, or drawing images, etc., it is necessary to transfer large volumes of image data at high speed between the main memory 53, the GPU 62, the MDEC 64, and the decoder 82.

In order to do so, in this image processing system, DMA transfer can be performed by transferring data directly between the main memory 53, the GPU 62, the expansion circuit (MDEC) 64, and the decoder 82, under the control of the peripheral device controller 52. This shows that the CPU 51 is not used during the DMA transfer as described before. Thus provision is made for reducing the loads placed on the CPU 51 by data transfers, and for conducting data transfers at high speed.

Figure 5:
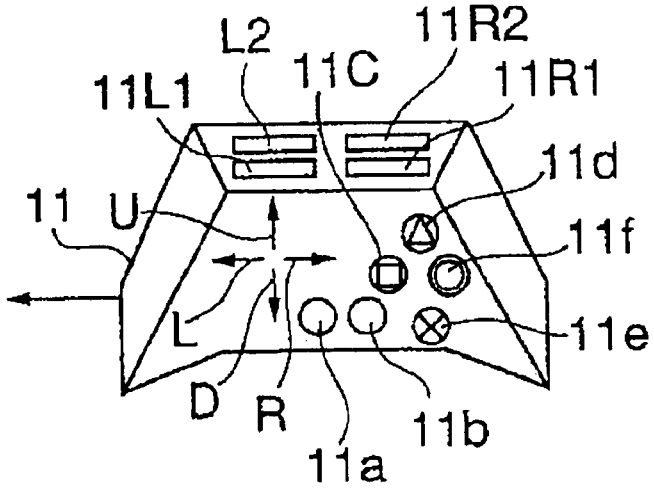
FIG. 5 is a block diagram of the internal configuration of the game machine main unit shown in FIG. 1.

Next, with reference to FIG. 5, the controller 11 used in the game apparatus of the present invention is described in more specific terms. On the upper surface of the controller 11 are deployed cross keys consisting of a left key L, right key R, up key U, and down key D, a start button 11*a*, a select button 11*b*, and first to fourth buttons 11*c*, 11*d*, 11*e*, and 11*f*. As shown, these first to fourth buttons 11*c* to 11*f* are marked by the symbols □, Δ, ○, and,•and are called the □, Δ, ○, and•buttons, respectively.

On the front side surface of the controller 11 are deployed first and second left buttons 11L1 and 11L2, and first and second right buttons 11R1 and 11R2. To these first and second left buttons 11L1 and 11L2 and first and second right buttons 11R1 and 11R2 are assigned functions for each game, such as area settings, cursor movement units, and the like.

Of the keys described in the foregoing, the cross keys are used for sending commands to the CPU 51 to move a character or the like subject to movement up, down, left, or right. The start button 11*a* is used for instructing the CPU 51 to begin operations based on game program data read out and loaded from the recording medium 84. The select button 11*b* is for notifying the CPU 51 of various selections relating to the game program, etc., loaded into the main memory 53 from the recording medium 84.

Herein, it often happens that it is necessary to store setting data for the game, game results at the end of a game or midway in a game in memory. In this event, the CPU 51 sends the data to the communication control device 91, while the communication control device 91 can store the data from the CPU 51 in a memory card similar to the memory card device 20. The data stored in the memory card device 20 can also be sent to the CPU 51, or the data name modified.

Next, a card game relating to the present invention is first described in order to facilitate comprehension of the present invention, even though the card game executed in a first embodiment aspect of the present invention is similar to the card game described in Japanese Unexamined Patent Publication (JP-A) No. 2000-157744.

In the card game relating to the first embodiment of the present invention, play is carried out by players reciprocally playing out cards, that is, by placing cards on an arena established on the screen of a display device 65 such as a home television receiver. In this example, description will be made about the case where two players have individual controllers 11 and are connected in common to the main unit 10. In this situation, the card game is played between those two players. However, one player may play the card game against the computer.

For the cards used in this card game, 700 species of cards are assumed to be prepared. In playing the card game, a limited number of cards out of those 700 species of cards are used, and those cards are reciprocally played out on the arena, designating attacks and defenses, until the life points of one of the players become zero. Depending on the card game, the losing player whose life points became zero gives one card to the winning player.

Figure 6:
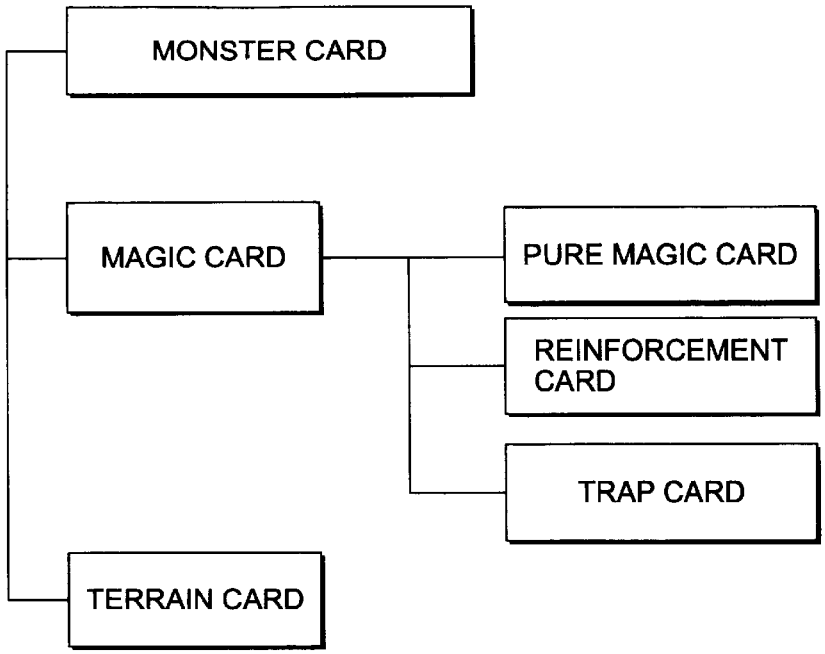
FIG. 6 is a diagram for describing the types of cards used in a card game relating to the present invention.

The cards used in the card game relating to the present invention are now described while referring to FIG. 6. As shown in FIG. 6, the 700 species of cards used in the present invention are largely categorized or divided into monster cards, magic cards, and terrain cards.

Of these cards, the monster cards are provided with attack power (represented by an attack ability index AP) and defense power (represented by a defense ability index DP) according to the monster displayed on the card. The monster cards are further classified such that they have one of six attack attributes, namely light, darkness, water, flame, earth, and wind. In this embodiment aspect, each monster card may have two attributes out of those six attack attributes, and provision is made so that a player can select one or other of those two attributes. Between these six attack attributes are established superiority/inferiority relationships, that is, mutually complementary superiority/inferiority relationships such that light group cards are superior to darkness group cards but are inferior to the wind group, for example.

The magic cards, on the other hand, are cards which bring about or manifest a certain effect or influence on cards played onto the arena. These magic cards can be further classified, as shown, into pure magic cards, reinforcement cards, and trap cards. Of these, the pure magic cards, when placed face up on the arena, manifest on that arena effects determined for those pure magic cards, and disappear from the screen. In the face down condition, such that the pure magic cards are placed on the arena with the face hidden, they can manifest effects when a player turns them face up at any time when it is his or her turn. The pure magic cards provided in this embodiment aspect, depending on the effect activated, can be further classified into direct attack cards, card attack cards, sealed cards, restoring cards, and display cards. The direct attack cards here are cards which immediately reduce the life points of an opponent. The card attack cards are cards that manifest such effects as weakening or wiping out an opponent's cards from the arena. The sealed cards can manifest effects to render ineffective an offensive or defensive deployment of an opponent or to disable action by an opponent during his or her turn. The restoring cards are effective in restoring one's own life points. And the display cards are provided with such effects as turning face down cards of an opponent face up.

Of the cards described in the foregoing, the reinforcement cards are for enhancing the power of a monster card by being placed immediately on top of the monster card, when played face up onto the arena. Thereafter, the reinforcement cards disappear from the screen when the reinforcement attempt succeeds or fails. The reinforcement card, as will be described subsequently, can be placed into a hand card area together with a monster card. Such an operation may be called a combination play (simply called a combo play) in a sequence. At any rate, the reinforcement card may be placed into a hand card area within a hand card sequence.

Of the magic cards, furthermore, the trap card is a card that automatically manifests its effects when an opponent attack meets certain conditions, that is, meets the activation conditions. When this trap card is placed in a face down condition, it is turned face up to manifest its effects.

The field cards represent the battle field where the card game is being played. The illustrated field cards are representative of seven types of battle fields, namely forest, wilderness, mountain, savanna, sea, darkness, and light (or battlefield). The attack ability index (AP) and defense ability index (DP) of the monster cards are set so that they are modified in dependence on these field cards.

Figure 7:
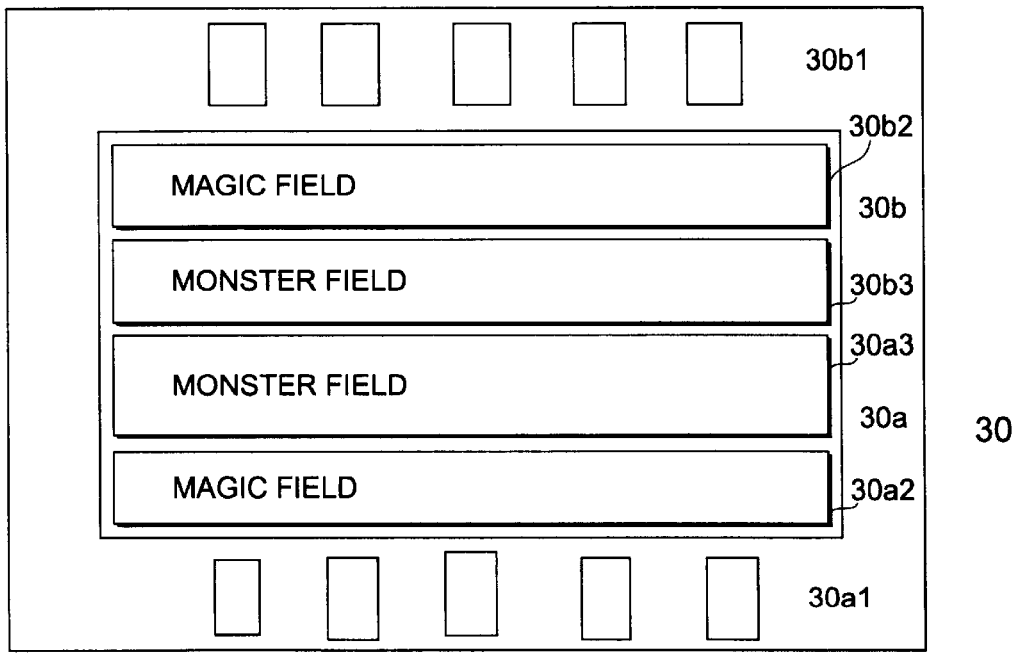
FIG. 7 is a diagram for describing a display screen in a card game of the present invention.

Referring to FIG. 7, a screen 30 is now displayed on the display device 65 (FIG. 4) during the course of a card game in the present invention. In the description, it is mainly assumed that, as shown in FIG. 1, the card game is played by two players by the use of a single display device 65 and individual controllers 11. The screen 30 on the display device 65, as shown, is divided into two areas above and below, namely area 30*a* and area 30*b*. The area 30*a* in the lower half is assigned as the area for a first player and the area 30*b* in the upper half is assigned as the area for the other player. When a single player competes against the computer, the area 30*a* in the lower half is assigned to that player, and the area 30*b* in the upper half is assigned to the computer.

The area 30*a* in the lower half and the area 30*b* in the upper half are vertically symmetrical with each other. In this situation, the description will be focused mainly on the area 30*a* in the lower half. The area 30*a* in the lower half is further demarcated into three partial areas 30*a*1, 30*a*2, and 30*a*3. In the area 30*a* in the lower half, the partial area 30*a*1 positioned lowermost is the hand card area. Into this partial area 30*a*1 are dealt five cards from the deck to form the hand, deployed face down. In this condition, the card numbers in the deck are marked on the cards deployed face down. In this event, each player can verify each face down card by manipulating the memory card device 20. The partial area 30*b*1 positioned uppermost in the field 30*b* in the upper half is a field corresponding to the partial field 30*a*1, forming the hand card area of the opponent.

The partial areas 30*a*2 and 30*a*3 above the partial area 30*a*1 that is the hand card area, together with the partial areas 30*b*2 and 30*b*3 on the opponent side, configure the playing arena for playing the card game, that is, the arena. Among these partial areas, the partial area 30*a*1, called the magic field, is a field for deploying the magic cards and field cards described earlier. A maximum of five cards can be deployed in this magic field 30a1. The same is also true of the partial field 30*b*1 that corresponds to this partial field 30*a*1.

The partial area 30*a*2 positioned above the magic field 30*a*1 is called the monster field, as is the partial area 30*b*2. A maximum of five of the monster cards described earlier can be deployed in this partial area. The game is carried on by playing cards onto the arena configured by these partial areas, namely the monster fields 30*a*3 and 30*b*3 and the magic fields 30*a*2 and 30*b*2.

Figure 8:
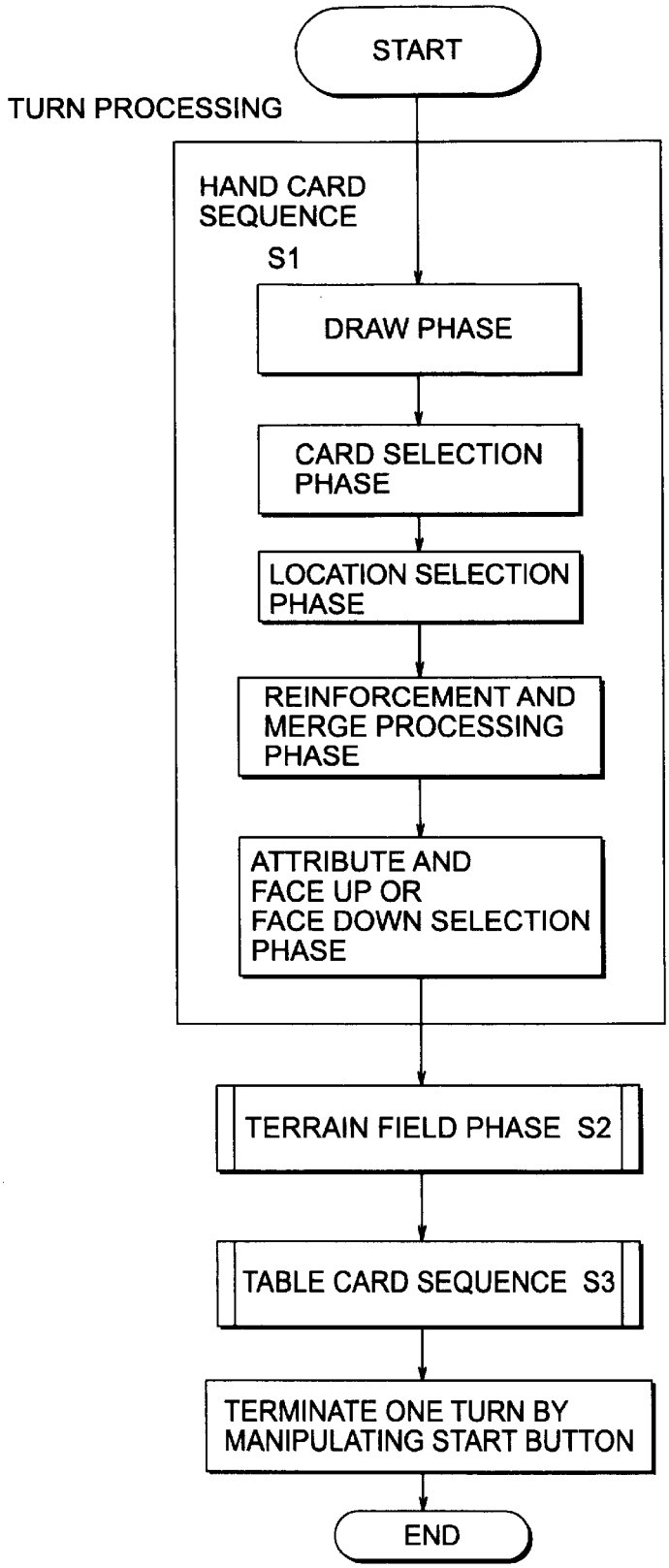
FIG. 8 is a flowchart for generally describing the process flow for processing a card game relating to the present invention.

The rules of the card game relating to the present invention, and the processing done during the card game, are now described with reference to FIG. 8. In FIG. 8 is shown the processing that is executed during one turn of one player. First of all, it becomes the turn of the first player as soon as the turn of the opponent is finished. The processing executed during this turn, as shown, comprises a hand card sequence S1, a terrain field sequence S2, and an arena card sequence S3. Of these sequences, in the hand card sequence S1, processing is performed for deploying cards dealt from the deck into the hand card area 30*a*1. This hand card sequence S1 is divided into a draw phase, a card selection phase, a location selection phase, and an attribute and face up or face down selection phase. In addition, as necessary, when a card reinforcement or merge occurs, preliminary processing for that reinforcement or merge is also executed.

Of the various phases noted above, in the draw phase, action is performed to replenish the hand card area 30*a*1 with cards taken from the deck. When there cease to be five cards in the hand card area 30*a*1, that player is judged at that point in time to be the loser.

The card selection phase is a phase wherein selection is made as to which of the cards deployed in the hand card area 30*a*1 is to be played on the arena. One of the features of the card game relating to the present invention here is that, in the hand card sequence, merging or reinforcement can be performed by deploying a plurality of cards in the hand card area, making a so-called combo play. In other words, a feature of the card game of this present invention is that a plurality of cards can be deployed at one time, in a hand card sequence, only in the case of merging or reinforcement.

For that reason, in this card selection phase, it is necessary to monitor what kind of combinations cards are to be deployed in, and to perform processing commensurate with those combinations. In this embodiment aspect, combo plays involving combinations of a plurality of monster cards and combo plays involving combinations of a monster card and a reinforcement card are detected.

Describing this in even greater detail, in the hand card sequence, by making a combo play with a plurality of monster cards, it is possible to generate one new monster card and perform merging. The new monster card obtained by combining a plurality of cards in this way is represented prior to the table card sequence in face up condition on the arena. In the hand card sequence, when a merge is performed, a new card is generated after a condition wherein a plurality of cards has been merged is displayed. This merging process can be observed by the opposing player as well as by the first player, wherefore the opponent can also recognize by what card combination the merging into a new card occurs.

It is also possible, with a hand card sequence combo play, to promote the power of a specific monster card by combining the specific monster card with a magic card that is a reinforcement card shown in FIG. 6. The specific monster card that was reinforced has attack and defense ability index values that are larger than those of the specific monster card. This reinforced specific monster card is deployed face up on the arena prior to the table card sequence, and the reinforcement process can also be observed by the opposing player because it is displayed on the screen.

In the event of a combo play, a plurality of cards that become candidates for the combo play is determined in the hand card area 30*a*1 by using the Δ button 11*d* shown in FIG. 5, while merging and reinforcement are performed by manipulating the ○ button 11*f*, and, after the merge and reinforcement screen described earlier is displayed, one card is deployed on the arena. Thus combo plays in the hand card sequence are only permitted in this embodiment aspect when there is a merge or reinforcement, and, when such a combo play is made, processing is performed for the merge or reinforcement described earlier, prior to the table card sequence.

In the hand card sequence, when a single card play is made, the place where the card selected is put down is selected in the location selection phase. In the case of a single card play, if the card selected from the hand card area 30*a*1 is a monster card, the monster field 30*a*3 is selected, whereas, if it is a magic card or terrain card, the magic field 30*a*2 is selected. When, on the other hand, reinforcement is performed by a monster card and a reinforcement card in the hand card sequence, and also when a merge is performed with a plurality of monster cards, the monster fields 30*a*3 and 30*b*3 are selected for the reinforced or merged cards.

Here, the monster cards are played in a turned down condition, that is, in a face down condition on the arena, relative to the monster field 30*a*3, but in the case of a combo play, a setting is made so that they are forced to be face up, as described before.

Magic cards, on the other hand, can ordinarily be deployed in a turned down condition in the magic field 30*a*2. When a magic card is played on the arena in a turned down condition, that is, in a face down condition, the opponent side will not know what kind of magic card has been played, wherefore the influence on the opponent is extremely great. Thus there is a danger that, if players try to collect only the magic cards having great influence, the interest of the card game, the original purpose whereof is to have monster cards battle each other, will be impaired.

In this embodiment aspect, giving consideration to that danger, when a magic card has been played turned down, a tax is levied or imposed, in the hand card sequence, against the player making that turned down play, as a tax on the later effects that will result from that turned down play, as will be described subsequently. For this reason, in this embodiment aspect, a determination is made as to whether or not a magic card was played turned down, that is, whether that magic card is face down or face up, in the hand card sequence, and that tax is subtracted from the life points of that player. As a result, the life point of the player is reduced.

A player who wants to avoid such a tax may play those magic cards face up on the arena. However, when the magic card played face up in the arena is a trap card, that trap card played face up will have almost no effect. When a pure magic card is played face up on the arena, the effect determined for that pure magic card is activated on that arena. When a reinforcement card is played face up on the arena, and placed immediately on top of a monster card in the monster field 30*a*3, the success or failure of the reinforcement is determined at that point in time, and that reinforcement card disappears from the screen.

When a magic card played turned down is a pure magic card, the effect thereof can be manifested by turning that pure magic card face up any time during a player's turn. In the case of a reinforcement card, at the point in time that it is turned face up, it moves from the magic field 30*a*2 to the monster field 30*a*3, is placed on top of a monster card, and disappears from the screen after the success or failure of the reinforcement has been determined. In the case of a trap card that is in a turned down condition, when the attack of the opponent matches activation conditions determined for that trap card, that trap card is automatically turned face up and the effect thereof is activated.

In the attribute and face up or face down selection phase of the hand card sequence S1 described in the foregoing, when a card played on the arena is a monster card, one or other of the two attack attributes assigned to that monster card is selected.

When cards played on the arena are magic cards, moreover, in the face up or face down selection phase, selections are made to turn the magic cards face up or face down. When face up is selected for a pure magic card, the effect of that pure magic card is activated there on that arena, and that pure magic card itself disappears from the screen. In the case of a reinforcement card, when face up is selected, as described earlier, it is placed immediately on top of a monster card in the monster field 30*a*3, whereas, when face down is selected, that reinforcement card is deployed in the magic field 30*a*2. Trap cards, on the other hand, are placed in the magic field irrespective of whether face up or face down.

When the hand card sequence S1 described in the foregoing is finished, the terrain field sequence S2 is transitioned to. In the terrain field sequence, a terrain card is determined such that only one thereof can be played on the arena by a friend and foe (opponent) together, and the attack and defense ability indexes of the monster cards are complemented in accordance with that terrain card. When no terrain card has been played, the normal field (light) determined as the default condition is designated.

After the terrain field sequence, the table card sequence S3 is executed. In the table card sequence, with respect to monster cards or magic cards played on the arena, automatic processing is executed for all cards played on the arena, in a free cursor format. The content of this processing differs according as to whether the card played on the arena is a magic card or a monster card.

First, in the case where a card played on the arena is a magic card, the table card sequence is divided into an activation selection phase, magic activation processing phase, reinforcement subject selection phase, and reinforcement processing phase. Processing relating to magic cards played face up and processing for combo plays related to magic cards have already been executed in the hand card sequence S1, wherefore, in this table card sequence, processing is performed for magic cards that are turned down.

In the activation selection phase in the table card sequence, selection is made as to whether or not a player has turned face up a magic card that was turned down. Following thereupon, in the magic activation processing phase, determination is made as to whether a magic card is a pure magic card, reinforcement card, or trap card and, when it is determined that a face up magic card is a pure magic card, the magic effect thereof is activated.

When it is determined that a magic card turned face up by a player is a reinforcement card, moreover, the reinforcement subject selection phase is transitioned to. The reinforcement subject selection phase is executed when a monster card reinforced by that face up reinforcement card is selected.

When a monster card is selected together with a reinforcement card by a player, the reinforcement processing phase is shifted to. In the reinforcement processing phase, the reinforcement card moves to the monster field, to a position on top of the monster card selected in the reinforcement subject selection phase, that monster card is reinforced, and table card sequence processing terminates.

When it is determined in the table card sequence that a card played on the arena is a monster card, on the other hand, first an attack or defense selection phase is executed. In this attack or defense selection phase, the attack or, alternatively, the defense of the monster card played on the arena is selected by the player. In this case, attack or defense is selected by manipulating the R1 button 11R1 (FIG. 5) and the L1 button 11L1 (FIG. 5) of the player. In the attack or defense selection phase, furthermore, monster cards are not turned face up but continue to be turned down.

When the attack or defense selection phase is finished, the battle target selection phase is transitioned to. In the battle target selection phase, the cursor is placed over the monster card for which attack was selected. Then, when the ○ button 11*f* and/or □ button 11*c* is manipulated by the player, a condition is effected wherein a card on the opponent side of the arena can be selected as the battle target.

When a card is selected as a battle target, the cursor is placed over that battle target card, and the ○ button 11*f* or □ button 11*c* is depressed by the player, the battle processing phase is transitioned to, a battle is started between the monster cards, and a determination is made as to who won and who lost. In the condition wherein a monster card has been selected to be a battle target, different screens will be displayed depending on whether the ○ button 11*f* or the □ button 11*c* was depressed.

The table card sequence described in the foregoing is terminated by depressing the start button 11*a*, whereupon the turn of that player also terminates and it becomes the opponent's turn.

Thereafter, similar operations are performed, sequentially, until the life points of one of the players become zero.

Here, in the card game of the present invention, as described earlier, in addition to turning magic cards down, combo plays are also recognized wherein, in the hand card sequence, a plurality of cards is selected in the hand card area 30*a*1. However, if these combo plays and face down plays are recognized without limitation, the result will be to diminish the interest fundamental to the card game, as was discussed earlier.

Taking that fact into consideration, in the card game relating to the present invention, taxes are levied against combo plays and face down plays, corresponding to the effects thereof. These taxes are described in greater detail below.

First, against a combo play, as a tax against the making of that combo play, a limitation is imposed that decreases the life points of a player making the combo play by 500 points. In other words, provision is made so that a combo play cannot be made when the life points have been diminished by 500 points. There are cases, furthermore, where all of the cards in the deck will be gone due to the rampant use or overuse of combo plays. Therefore, a setting is made so that, when there are no longer five cards deployed in the hand card area 30*a*1 or 30*b*1, that player loses. Thus it is possible to protect against reductions in force maneuverings or the number of turns due to the rampant use of combo plays. In addition, even a player having only weak cards in his or her hand, by persevering with defensive displays, has a possibility of winning against an opponent who attacks repeatedly with strong combo plays, making it possible to further enhance the interest of the card game.

A tax is levied against turning down magic cards, on the other hand, that is, a limitation is imposed, so that the life points of a player making face down plays of magic cards are reduced by 100 points every time a face down play is made. Thus, by establishing a tax also against the face down playing of magic cards having strong effects, players are prevented from abusively using magic cards.

In the example discussed in the foregoing, taxes are established against both combo plays and face down plays, and players are forced to take risks, but it is permissible instead to impose a tax on either combo plays or face down plays only. In any case, by imposing risks on combo plays and/or face down plays, which can become powerful measures in the card game, the misuse of these powerful measures is prevented.

Figure 9:
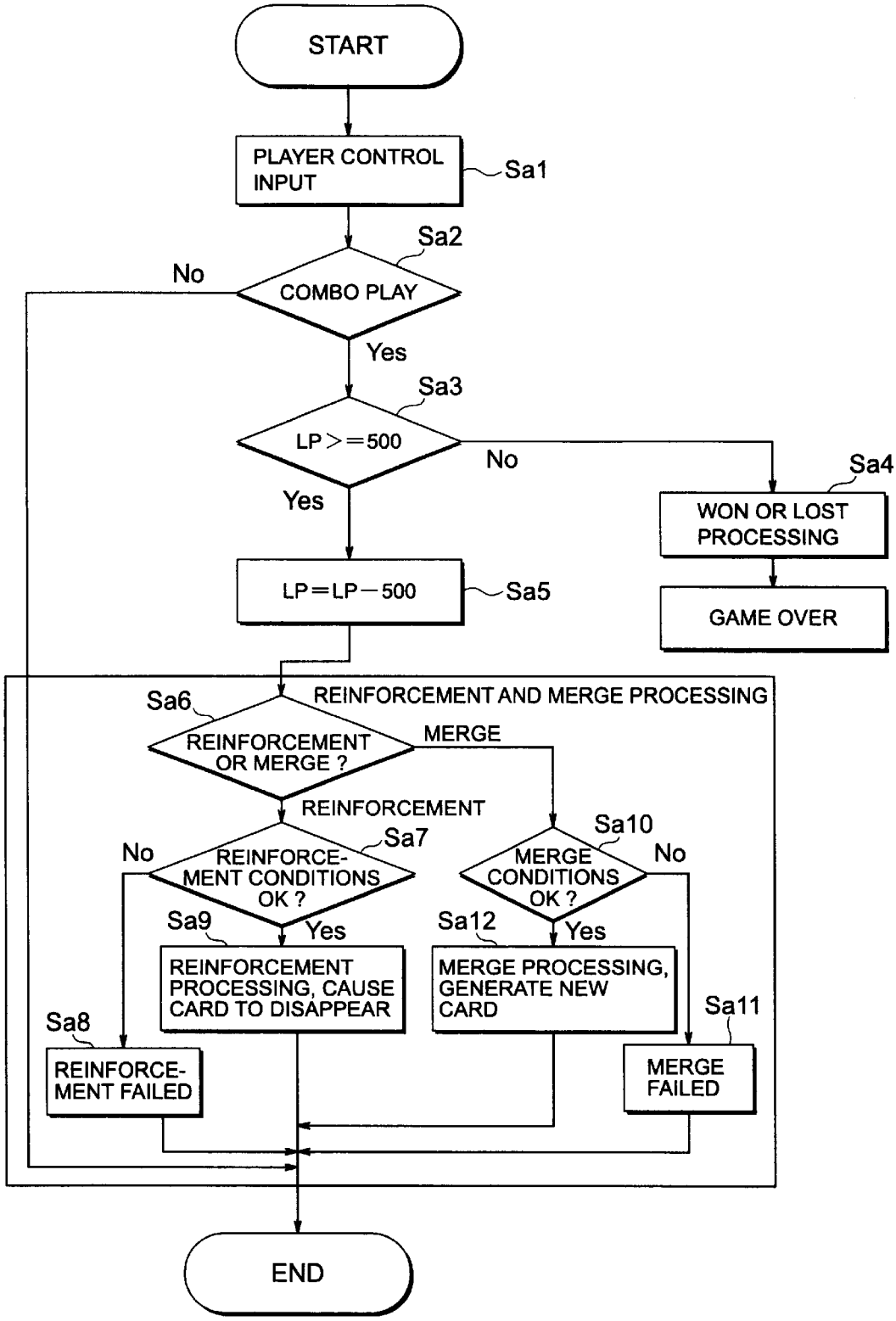
FIG. 9 is a flowchart for describing a reinforcement and merge phase in the process flow shown in FIG. 8.
Figure 10:
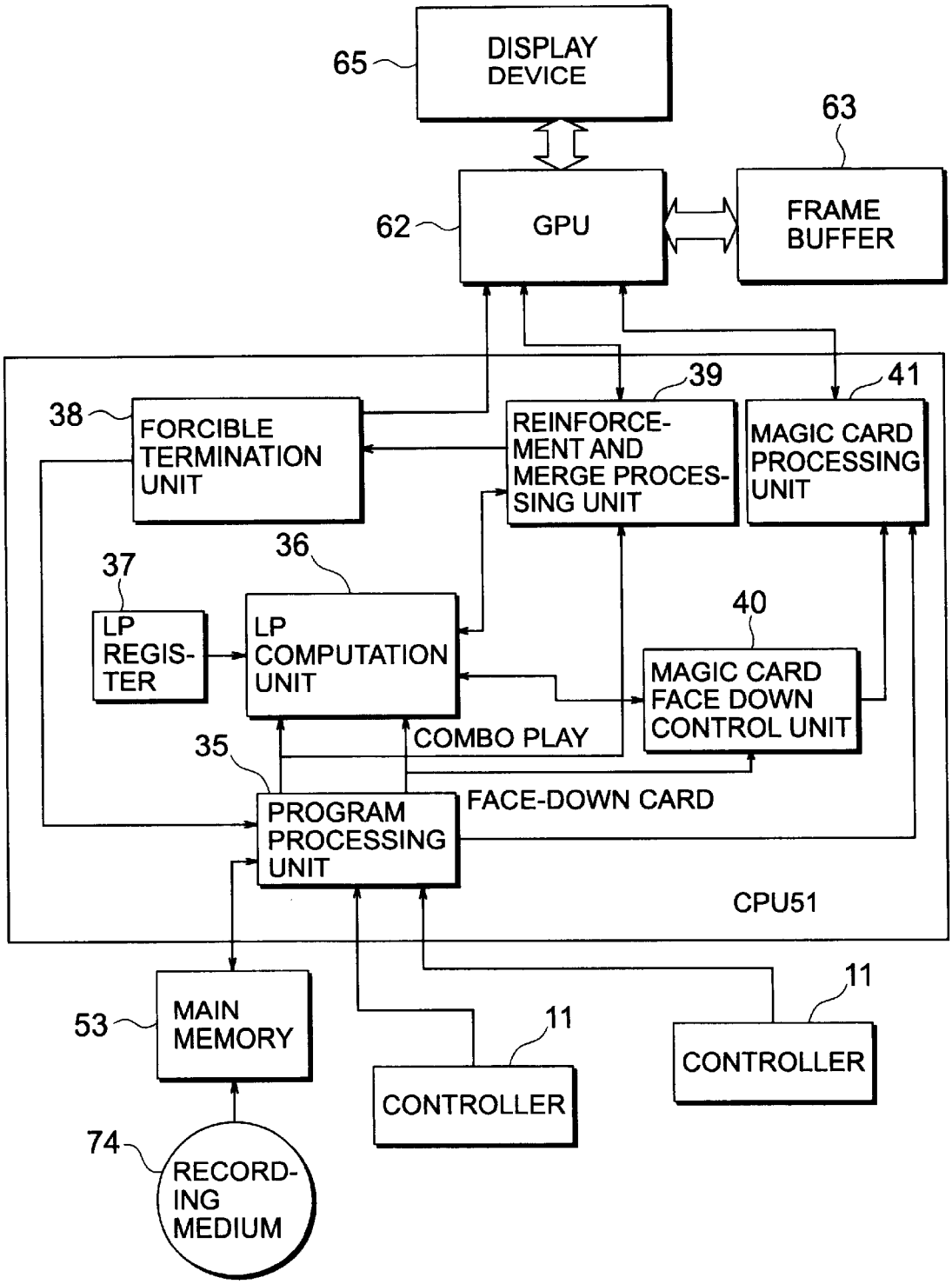
FIG. 10 is a block diagram for describing, function by function, a game system for implementing reinforcement and merge phase and an attribute and face up or face down selection phase in the process flow shown in FIG. 8.

The combo plays made in the reinforcement and merge processing phase in the hand card sequence S1 shown in FIG. 8 are now described in detail with reference to FIG. 9 and FIG. 10. In the functional block diagram shown in FIG. 10, however, in the interest of simplifying the description, only the CPU 51, controllers 11, recording medium 74, main memory 53, GPU 62, frame buffer 63, and display device 65 are shown, and only those parts related to the reinforcement and merge processing phase and the attribute and face up or face down selection processing phase are represented. This processing is executed by the CPU 51 for the purpose of displaying the card game images on the display device 65, according to control signals from the controllers 11 that are input means and the program that defines the card game procedures which is stored on the recording medium, wherefore the CPU 51 is here called image display control means.

It is assumed here, moreover, that two controllers 11 are connected to the main unit 10 of the game apparatus, that the card game is played by two players, and that the card game program relating to the present invention is deployed from the recording medium 74 into the main memory 53. Only the processing performed in a turn of one player is described, but, needless to say, the same processing is also performed during the turn of the other player.

Figure 11:
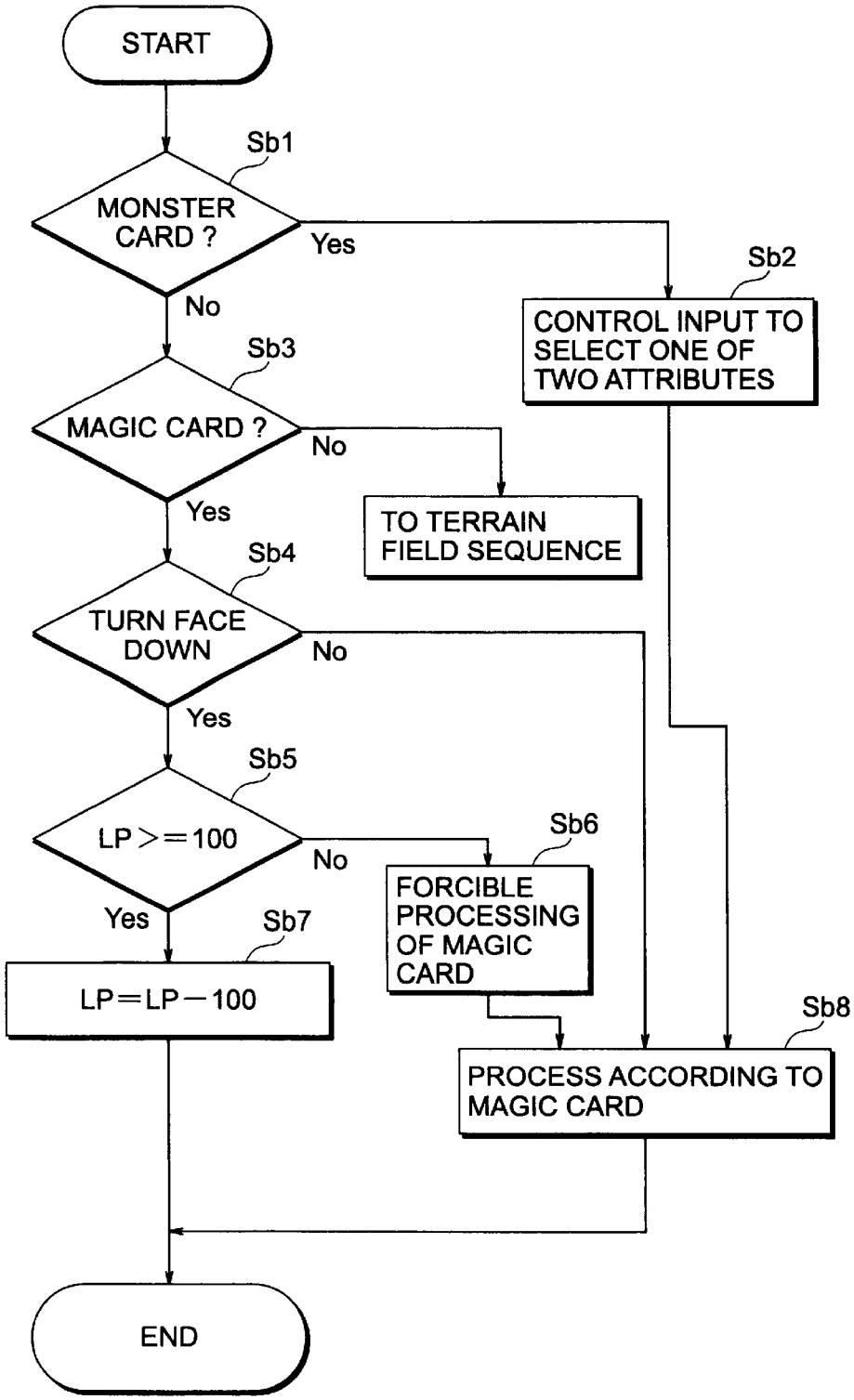
FIG. 11 is a flowchart for describing the attribute and face up or face down selection phase of FIG. 8.

When cards are input (step Sa1) by a player making control inputs with the ○ button 11*f* and □ button 11*c* on the controller 11, those control inputs are sent to a program processing unit 35. In the program processing unit 35, a determination is made in step Sa2 as to whether or not the control inputs made by that player involve a combo play that deploys a plurality of cards on the arena in one turn. When it is not a combo play, that is, when only a single card is deployed on the arena, the reinforcement and merge phase in the hand card sequence terminates, and the terrain field sequence shown in FIG. 11 is transitioned to. When it is detected by the program processing unit 35 that the player made a combo play, in step Sa2, on the other hand, the program processing unit 35 activates an LP computation unit 36. The LP computation unit 36 accesses an LP register 37 wherein life points (LPs) are stored, and fetches the life points (LPs) of that player. In the LP computation unit 36, a determination is made (step Sa3) as to whether or not the life points fetched from the LP register 37 total 500 points or more. When that total is short of 500 points, a forcible termination unit 38 is activated, the won or lost processing in step Sa4 is executed, and that player is determined to have lost. The forcible termination unit 38 causes the game for that time to be forcibly terminated by the GPU 62 and the program processing unit 35.

When it is determined by the program processing unit 35 in step Sa3 that a player has 500 or more life points, the LP computation unit 36 subtracts 500 points as a penalty or tax from the life points read out from the LP register 37 for that player, and stores the remaining number of points back in the LP register 37 as the new LP value for that player (step Sa5).

Thus reinforcement and merge processing is executed in a condition wherein points have been subtracted from the life points of a player who has made a combo play. In the case of the example shown, the reinforcement and merge processing unit 39 executes step Sa6 through the program processing unit 35. The reinforcement and merge processing unit 39 determines, in step Sa6, whether this is a combo play for promoting a monster card or a combo play for merging monster cards. That is, the reinforcement and merge processing unit 39 makes a determination of reinforcement or merging by determining, in step Sa6, whether the combo played card combination is a combination of a monster card and a reinforcement card or a combination of monster cards.

When it is determined in step Sa6 that the combo played cards are a monster card and reinforcement card combination, the reinforcement and merge processing unit 39 determines that reinforcement processing is being requested by the combo play, and shifts to that processing routine in step Sa7.

In step Sa7, the reinforcement and merge processing unit 39 determines whether or not the combo played monster card and reinforcement card combination meets predetermined reinforcement conditions. In this case, the reinforcement and merge processing unit 39, in addition to determining whether or not the combo played cards are a specific monster card and reinforcement card combination subject to reinforcement, also searches for the reinforced monster card assigned to that specific monster card and reinforcement card combination. If the combination of combo played monster card and reinforcement card does not match the reinforcement conditions (NO in step Sa7), then the reinforcement and merge processing unit 39 detects that the reinforcement has ended in a failure, and controls the display device 65 through the GPU 62 and the frame buffer 63. As a result, only the monster card remains on the screen of the display device 65, and the reinforcement card disappears from the screen (step Sa8). If, on the other hand, the reinforcement and merge processing unit 39 detects that this is the specific monster card and reinforcement card combination (YES in step Sa7), one reinforced monster card preassigned to that combination is generated and sent to the display device 65 via GPU 62. As a result, the single reinforced monster card is displayed face up on the arena on the screen of the display device 65, and the reinforcement card itself is erased from the screen (step Sa9). The reinforced monster card has a higher attack or defense ability index than does the unreinforced monster card.

In step Sa6, on the other hand, when it is determined by the reinforcement and merge processing unit 39 that this is a monster card combination combo play, the reinforcement and merge processing unit 39 executes step Sa10. In step Sa10, the reinforcement and merge processing unit 39 determines whether or not that monster card combination meets the merge conditions. If the merge conditions are not met, the reinforcement and merge processing unit 39 detects that the merge has failed (step Sa11), and controls the display on the display device 65 through the GPU 62. In this case, in the combo play, only the monster card played later remains on the screen of the display device 65, and display control is effected so that the card(s) played earlier disappear (s), whereupon that reinforcement and merge phase terminates.

Next, when it is determined by the reinforcement and merge processing unit 39 that the monster card combination matches the merge conditions, in step Sa10, a new monster card assigned in correspondence with that monster card combination is displayed on the screen of the display device 65, under the control of the GPU 62 (step Sa12), and the reinforcement and merge phase in the hand card sequence terminates. This new monster card will not necessarily always have a higher attack ability index or defense ability index than the monster cards prior to the merge. In some cases it will become a card having a lower attack or defense ability index. In this way the card game is provided with many more variations.

As described earlier, moreover, for cards played on the arena, reinforcement or merge processing can be performed by playing one reinforcement card or monster card on the arena, even in the table card sequence. This reinforcement or merge processing is the same as the reinforcement or merge processing done when a combo play is made, as described earlier, excepting in that the player's life points are not reduced and also in that processing is done to move a reinforcement card or monster card over the monster card targeted, and so is not described further here.

The processing done in the attribute and face up or face down selection phase executed in the hand card sequence is described next, with reference to FIG. 11 as well as to FIG. 10, focusing especially on the processing done when a magic card has been turned down. In attribute and face up or face down selection phase processing, a determination is first made by the program processing unit 35 as to whether or not the card played on the arena is a monster card (step Sb1). The program processing unit 35, upon detecting that this is a monster card, in step Sb2, urges the player to select one or other of the two attributes assigned to each monster card. When the monster card attributes have been selected by the player manipulating a button (step Sb2), the program processing unit 35 terminates that attribute and face up or face down selection phase processing.

If in step Sb1 the card deployed in the hand card area is not a monster card (NO in step Sb1), on the other hand, the program processing unit 35 determines whether it is a magic card or a terrain card (step Sb3). If it is a terrain card and not a magic card, the program processing unit 35 terminates the attribute and face up or face down selection phase and transitions to the terrain field sequence S2 shown in FIG. 8.

If the program processing unit 35 detects in step Sb3 that this is a magic card, it then determines in step Sb4 whether or not that magic card is turned down or not. If the magic card is turned face down (YES in step Sb4), a magic card face down control unit 40 is activated, whereupon that face down control unit 40 determines whether or not the remaining life points of that player total 100 or more (step Sb5). If the life points are less than 100 (NO in step Sb5), the face down control unit 40 indicates to the player through the GPU 62 that a face down play cannot be done, processing is executed to forcibly turn the magic card face up (step Sb6), and the attribute and face up or face down selection phase is terminated. Provision may also be made so that, as in the case of a combo play, when the life points become fewer than 100, won or lost processing is executed, that player is determined to have lost, and that game is terminated.

In step Sb5, furthermore, the face down control unit 40 accesses the LP register 37 through the LP computation unit 36, and reads out the life points for that player. If it is detected by the face down control unit 40 that the life points of that player total 100 or more (YES in step Sb5), then the face down control unit 40 subtracts 100 points as a tax from the life points of that player read out from the LP register 37, and stores the life points remaining after the subtraction as the new life point value in the LP register 37 (step Sb7).

When the magic card is not turned down (NO in step Sb4), and the magic card has been forcibly processed (in step Sb6), the magic card is in a face up condition. In this manner, in a condition where the magic card is turned face up, a magic card processing unit 41 is activated under the control of the program processing unit 35, and processing is executed commensurate with the type of that magic card by that magic card processing unit 41 (step Sb8). If the magic card is a pure magic card, for example, the effects thereof are activated on that arena, and the magic card processing unit 41 monitors player control inputs or prescribed effect activation conditions for reinforcement cards and trap cards. If it is a turned down magic card, on the other hand, the face down control unit 40, after subtracting 100 points from the life points (step Sb7), activates the magic card processing unit 41 and transitions to the table card sequence. In the table card sequence, as described earlier, the magic card processing unit 41 monitors player control inputs and effect activation conditions. When during a player's turn a pure magic card is turned face up or the effect activation conditions for a trap card are satisfied, effects are activated according to each magic card. In the case of a reinforcement card, moreover, the magic card processing unit 41 performs action to promote the monster card when the combination with the monster card satisfies the prescribed conditions.

In the embodiment aspect described in the foregoing, the description is focused mainly on the case where two players play a card game using a single display device, in a game system comprising a game apparatus main unit for executing the card game and a memory card device. This can also be similarly applied, however, in cases where one player plays the card game with the computer. In that case it is not always necessary to use a memory card device. Furthermore, the present invention is not limited to a game system that uses a CD-ROM as the recording medium 74, but can similarly be applied in game systems that use another recording medium such as a cassette or the like. In the embodiment aspect described in the foregoing, moreover, the taxes levied against combo plays and face down plays are 500 and 100 points, respectively, but those tax amounts may of course be made larger or smaller as necessary. Those taxes were also described as being levied only in cases of combination plays or face down plays, but the present invention is not at all limited thereto, and taxes may be additionally imposed against other eventualities that are set in the card game.

The present invention affords the benefit of being able to implement a card game offering more thrills, by subjecting the players to risks associated with combination plays, magic card face down plays, and the like, which exhibit very great effects in the card game. Moreover, by allowing combo plays that manifest the effects of merges and reinforcements and the like in the hand card sequence, it becomes possible to work out strategies before cards are placed on the arena. This is very effective to make the card game a fun by involving a higher level of strategy.

What is claimed is:

1. A game system for use in executing a card game, comprising:

processing means operative for implementing a card game procedure which is divided into a hand card process sequence for arranging cards in a hand card area displayed on a screen and an arena card process sequence for arranging cards in an arena card area displayed on said screen;

input means for inputting control signals on the basis of manipulation of each player; and image display control means for performing processing to display images relating to said card game, in accordance with to said control signals and the card game procedure;

wherein:

said image display control means comprises:

detection means, operable in the hand card process sequence, for detecting that an arrangement of a plurality of cards placed on said hand card area is matched with a prescribed combination;

said processing means being further operative for processing the arrangement the cards on the hand card area to display, on the screen, effects which correspond to the arrangement of the cards on detecting the match between the arrangement and the prescribed combination; and means for decreasing life points of each player as taxes on detecting the match between the arrangement and the prescribed combination.

2. The game system according to claim 1, wherein cards used in said card game includes a plurality of monster cards with ability indexes, respectively;

said processing means comprising:

means for detecting that the arrangement of the cards is matched with a monster card combination determined as the prescribed combination; and merge processing means for executing a merge operation such that the plurality of the cards arranged are changed to a single card which has an ability index different from the plurality of the cards;

the effects resulting from the merge operation being displayed on the screen prior to said arena card process sequence.

3. The game system according to claim 2, wherein cards used in said card game also include a reinforcement card that influences ability indexes of said monster cards;

the game system comprising:

reinforcing means for reinforcing an ability index of said monster card on occurrence of the reinforcement card and the monster card as said prescribed combination; the effects resulting from the reinforcement card being displayed on the screen prior to the arena card process sequence.

4. A card game system for use in executing a card game, comprising:

processing means operative for implementing a prescribed card game procedure, with images displayed on a display device;

input means for inputting control signals in response to manipulation of each player; and image display control means, responsive to the control signals, for carrying out processing to display card game images on said display device in accordance with the card game procedure;

said image display control means comprising:

detection means, responsive to the control signals, for detecting whether or not the predetermined card combinations are indicated in said card game to produce occurrence of the predetermined card combinations;

tax imposition means for imposing taxes on the player; and said processing unit being further operative for carrying out processing to display, on said card game images, effects associated with the occurrence of said predetermined card combinations;

said tax imposition means comprising a computation unit for subtracting said taxes from life points of the player when said predetermined combinations are caused to occur;

said image display control means displaying the effects produced due to said predetermined card combination before each card is placed on an arena.

5. A game system for conducting a card game, comprising:

processing means operative for implementing a card game procedure which is divided into a hand card sequence for arranging cards in a hand card area displayed on a screen and a arena card sequence for arranging cards in a arena card area displayed on said screen; wherein cards used in said card game include a plurality of monster cards each of which has its own ability index; and magic cards that bring about prescribed effects on those monster cards;

input means for inputting control signals; and image display control means, responsive to the control signals, for carrying out processing to display images relating to said card game in accordance with the card game procedure:

said image display control means comprising:

means for determining whether said magic cards are located in said hand card sequence, face up or face down; and means for reducing, as a tax, life points of a player who turns said magic cards face down.

6. The game system according to claim 5, wherein, in cases where said magic cards are placed face down, the prescribed effects assigned to said magic cards are caused to occur when said magic cards are turned face up.

7. The game system according to claim 5, wherein said image display control means also comprises:

detection means for detecting, in said hand card sequence, that arrangement of a plurality of cards on said hand card area is identical with a prescribed combination;

said processing means being further operative for carrying out processing to activate effects corresponding to that prescribed combination on said screen; and means for reducing life points of each player as taxes.

8. The game system according to claim 7, wherein said processing means comprise:

merge means for change the ability indexes of the card from one to another, when a combination of said plurality is identical with a combination of monster cards defined as said prescribed combination, by performing a merge operation.

9. The game system according to claim 7, wherein said magic cards also include a reinforcement card that influences ability indexes of said monster cards;

the game system comprising reinforcement means for reinforcing the ability index of said monster card, when the combination of said plurality of the cards is identical with the prescribed combination determined for a combination of said reinforcement card and the monster card.

10. A computer-readable recording medium for storing a program for conducting a card game, comprising the steps of:

implementing a card game procedure which is divided into a hand card process sequence for arranging cards in a hand card area displayed on a screen and an arena card process sequence for arranging cards in a arena card area displayed on said screen;

detecting, in said hand card process sequence, that an arrangement of the plurality of cards located on said hand card area is identical with a prescribed combination;

carrying out processing to display effects corresponding to that prescribed combination on said screen, when the arrangement is identical with said prescribed combination; and reducing life points of players as taxes on detection of said prescribed combination.

11. The recording medium according to claim 10, wherein: cards used in said card game include a plurality of monster cards having predetermined ability indexes;

said program comprising the steps of:

detecting that a combination of the plurality of cards is matched with a combination of monster cards determined as said prescribed combination; and changing said plurality of cards to a card which has a different ability index on detection of the match.

12. The recording medium according to claim 11, wherein cards used in said card game also comprise a reinforcement card that influences ability indexes of said monster cards;

said program comprising the steps of:

determining whether or not a combination of a plurality of cards is matched with a combination of said reinforcement card and a monster card that is determined as said prescribed combination; and reinforcing the ability index of said monster card when the combination of said plurality of cards is matched with said prescribed combination.

13. The recording medium according to claim 11, wherein cards used in said card game comprise magic cards that manifest prescribed effects on said monster cards; and said program comprises steps of: determining whether said magic cards are placed on the arena face up or face down in the hand card process sequence; and reducing life points of each player placing said magic cards when said magic cards is located face down.

14. The recording medium according to claim 13, wherein said program further comprises the step of delaying occurrence of prescribed effects, when said magic cards are located face down until said magic cards is turned face up.

15. The recording medium according to claim 12, wherein cards used in said card game comprise magic cards that manifest prescribed effects on said monster cards; and said program comprises steps of: determining whether said magic cards are placed on the arena face up or face down in the hand card process sequence; and reducing life points of each player placing said magic cards when said magic cards is located face down.

16. The recording medium according to claim 15, wherein said program further comprises the step of delaying occurrence of prescribed effects, when said magic cards are located face down until said magic cards is turned face up.

17. An image display method for displaying images on a display device to conduct a card game, comprising:

implementing a card game procedure that is divided into a hand card process sequence for deploying cards in a hand card area and an arena card process sequence for locating cards on an arena card area;

detecting that, in said hand card process sequence, an arrangement of said plurality of cards placed on said hand card area is matched with a prescribed combination;

carrying out processing to display, on said screen, effects corresponding to that prescribed combination on detecting the match between the arrangement and the prescribed combination,; and reducing life points of players as taxes on detecting the prescribed combination;

the effects on said screen being activated prior to said arena card process sequence.

* * * * *